US009387958B2

(12) United States Patent
Camacho Paredes et al.

(10) Patent No.: US 9,387,958 B2
(45) Date of Patent: Jul. 12, 2016

(54) COMFORTABLE OPENING CROWN METAL CAP

(75) Inventors: Juan Antonio Camacho Paredes, Monterrey (MX); Romualdo Segura Ruíz, San Nicolás de los Garza (MX); Carlos Adrián García Cortez, Monterrey (MX)

(73) Assignee: Fabricas Monterrey S.A. DE C.V. (MX)

( * ) Notice: Subject to any disclaimer, the term of this patent is extended or adjusted under 35 U.S.C. 154(b) by 0 days.

(21) Appl. No.: 14/124,709

(22) PCT Filed: Dec. 16, 2011

(86) PCT No.: PCT/MX2011/000166

§ 371 (c)(1), (2), (4) Date: Mar. 14, 2014

(87) PCT Pub. No.: WO2012/169869

PCT Pub. Date: Dec. 13, 2012

(65) Prior Publication Data

US 2014/0312001 A1 Oct. 23, 2014

(30) Foreign Application Priority Data

Jun. 8, 2011 (MX) ..... MX/a/2011/006098

(51) Int. Cl.
*B65D 41/02* (2006.01)
*B65D 41/12* (2006.01)

(52) U.S. Cl.
CPC ..... *B65D 41/02* (2013.01); *B65D 41/12* (2013.01)

(58) Field of Classification Search
CPC ..... B65D 41/00; B65D 41/32; B65D 41/34; B65D 41/02; B65D 41/12
USPC ..... 215/316, 324, 327, 328, 295, 305
See application file for complete search history.

(56) References Cited

U.S. PATENT DOCUMENTS 4,337,871 A * 7/1982 Tucker ..... 215/328
D516,426 S * 3/2006 Golding ..... D9/452
8,322,549 B2 * 12/2012 Bourque et al. ..... 215/328

* cited by examiner

*Primary Examiner* — Robert J Hicks
*Assistant Examiner* — Kareen Thomas
(74) *Attorney, Agent, or Firm* — Baker & Hostetler LLP

(57) ABSTRACT

A crown metal cap comfortable for opening by turning or with a bottle opener. The crown metal cap before folding, has a bell-shaped closure flange with a plurality of intercalated protrusions and depressions, the protrusions have a smaller width than the width of the depressions, and each depression has on its outer edge a convex fold; such that when closing the closure flange is folded over the mouth of the bottle, each protrusion bifurcates into a pair of minor protrusions that acquire a curved shape separated by a central depression that takes a similar form within a spheroid, forming a flange surface comfortable to touch to facilitate manual opening by turning; whereas the convex fold of each depression prevents the collapse of the outer edge of the depression to form a bell-shaped opening edge for easy opening of the crown metal cap with the bottle opener.

7 Claims, 4 Drawing Sheets

COMFORTABLE OPENING CROWN METAL CAP

TECHNICAL FIELD OF THE INVENTION

The present invention relates to metal caps, in particular it relates to a crown metal cap that can be opened easily by turning said cap or by using a bottle opener.

BACKGROUND OF THE INVENTION

Currently crown metal caps are made in one piece laminated with an inner and an outer face, circular and provided with a skirt around the perimeter of closure, which in turn is provided with a plurality of radial intercalated protrusions and depressions.

When applied to a bottle, the closure of the crown metal cap is airtight as the circular plane is pressed against the upper part of the bottle opening by applying the cap on it. Protrusions and depressions of the closure flange of the crown metal cap are folded and pressed at the same time by a forming tool against the bottle opening and slightly below it, providing a proper grip.

The crown metal caps can be of the type:

Metal cap "fixed" (known in English as PRY-OFF), which is one that can only be opened using a lever type opener.

Metal cap "easy open" (known in English as a TWIST-OFF), which is one that can be opened by applying a slight turn manually to cause the rotation of the same.

The metal caps "easy open" in turn could be classified as:

Metal caps of "rough touch" which is one with a closing flange, when folded, has a surface formed by generally pointed or sharp protrusions that are somewhat uncomfortable to touch.

Metal caps of the "comfortable feel" type, which is one with a closing flange, when folded, has a surface formed by generally round or flat protrusions that are comfortable to touch.

Examples of prior art of metal caps "easy open" of the "rough feel" type are described in the patent documents U.S. Pat. No. 5,458,253 and US-2005/029218.

Examples of prior art of metal caps "easy open" of the "comfortable feel" type are described in the patent documents CA-1,252,431, U.S. Pat. No. 3,648,874 and U.S. Pat. No. 4,337,871.

A current trend to produce metal caps "easy open" of the "comfortable feel" type is to design metal caps with a closing rim which, once it is folded to seal a mouth of a bottle, it has a larger number of protrusions than it had before being folded, as described by U.S. Pat. No. 4,337,871. However, it is very common that when a person wants to open this kind of caps "easy open" of the "comfortable feel" type with a bottle opener, the mouth of the bottle tends to break or crash, or said metal cap is damaged without opening. This problem is magnified in high-use facilities on site of beverages in bottles, such as bars, restaurants, at parties, conventions, etc., where the barman or "bartender" is forced to use a bottle opener to open sealed bottles with metal caps "easy open" to meet consumer demand, causing a high incidence of broken or crashed bottle openings, or with the metal cap damaged and remaining unopened. This problem is due to the limited space between the rim of the mouth of the bottle and the closure flange of the metal cap, which prevents a proper supporting point of the bottle opener, causing the opener to tend to this store to pull out without produce the opening of the metal cap, and thus the user tends to apply a greater force to the bottle opener with the risk of breaking or smashing the mouth of the bottle.

Now, with reference to U.S. Pat. No. 4,337,871 Raymond L. Tucker describes a "easy open" crown metal cap, which in its state prior to its closure for sealing a mouth 80 of a bottle consists of a circular plate piece and provided perimetrically of a bell-shaped closure flange formed by a plurality of protrusions 24 and depressions 25 (See FIG. 1). Each protrusion 24 has a width equal throughout its length and its width is greater than the width of each depression 25, so that when the closure flange folds over the mouth 80 of the bottle to be sealed (as shown in FIG. 2), each protrusion 24 collapses and forms a central depression 32 straight that splits the protrusion 24 in a pair of straight minor protrusions 31 to form a smooth surface of the closure flange and make the opening of the bottle easier when turning the metal cap manually. However, by folding the closure flange, each depression 25 folds in its full length over the mouth 80 of the bottle without leaving space between the rim of the mouth 80 of the bottle and the bottom rim of the folded flange, which is a problem because there is not enough space to pry a bottle opener for opening the metal cap, which is why the realization of the state of the art of the metal cap can only be opened manually when turning the cap, as when using a bottle opener the risk is run of breaking or crashing the mouth of the bottle.

In view of this, it is necessary to provide a crown metal cap that has the advantages of the opening mode "easy open" but of a "comfortable feel" type and that in turn can also be opened using a bottle opener without thereby causing damage to the mouth of the bottle which seals or the same metal cap.

SUMMARY OF THE INVENTION

In view of the above and for the purpose of solving the constraints found in the crown metal caps of easy opening, the object of the invention is to provide a crown metal cap that when seals a mouth of a bottle may be opened manually by turning said top metal lever or by using a bottle opener. The open crown metal cap has a laminated circular base piece and is provided perimetrically of a bell-shaped closure flange formed by a plurality of protrusions and depressions intercalated, the protrusions have a width smaller than the width of the depressions, and each depression has on its outer edge a convex fold; such that when the closure flange is folded over a mouth of a bottle to seal, each protrusion bifurcates into a pair of minor protrusions who acquire a curved shape separated by a central depression that takes a similar form within a spheroid, forming a comfortable surface of the flange to touch to facilitate manually opening of the crown metal cap; while the convex fold of each depression prevents the collapse of the outer edge of the depression to form a bell-shaped opening edge to facilitate the opening with the bottle opener of the crown metal cap.

BRIEF DESCRIPTION OF THE FIGURES

The characteristic details of the invention are described in the following paragraphs in conjunction with the accompanying figures, which are intended to define the invention but without limiting the scope thereof.

DETAILED DESCRIPTION OF THE INVENTION

This invention relates to a crown metal cap that when sealing the mouth of a bottle, can be opened manually by turning said metal cap or with a bottle opener used as a lever.

The inventors have found that it increases the degree of comfort to touch the metal cap "easy open", not only increasing the number of projections at the time when the resulting closure flange is folded, but it is necessary to have more protrusions in a straight line to the resulting protrusions in a curve that will result in an increase in the contact surface of the closure flange once it is folded closure for a comfortable grip with the hand.

Figure 1:
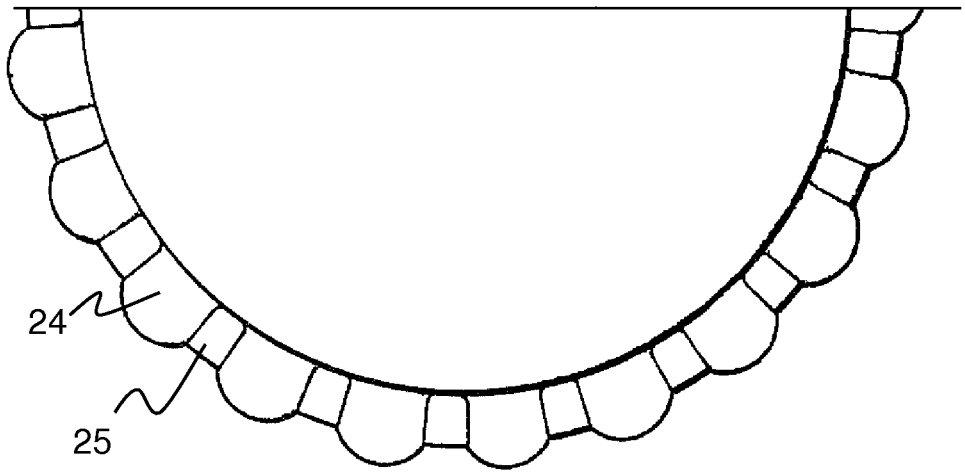
FIG. 1 shows a partial top view of a crown metal cap of the state of the art. The crown metal cap is illustrated in its state prior before closure for sealing a mouth of a bottle.
Figure 2:
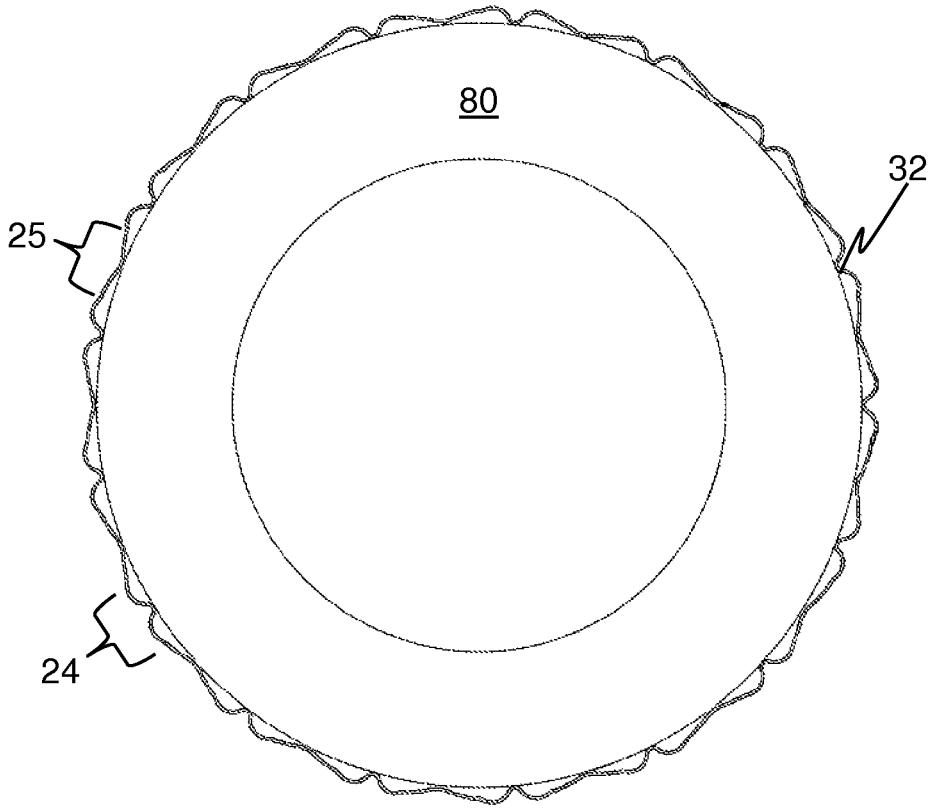
FIG. 2 shows a bottom view of the crown metal cap of the FIG. 1 of the state of the art. The crown metal cap is illustrated sealing the mouth of the bottle.
Figure 3:
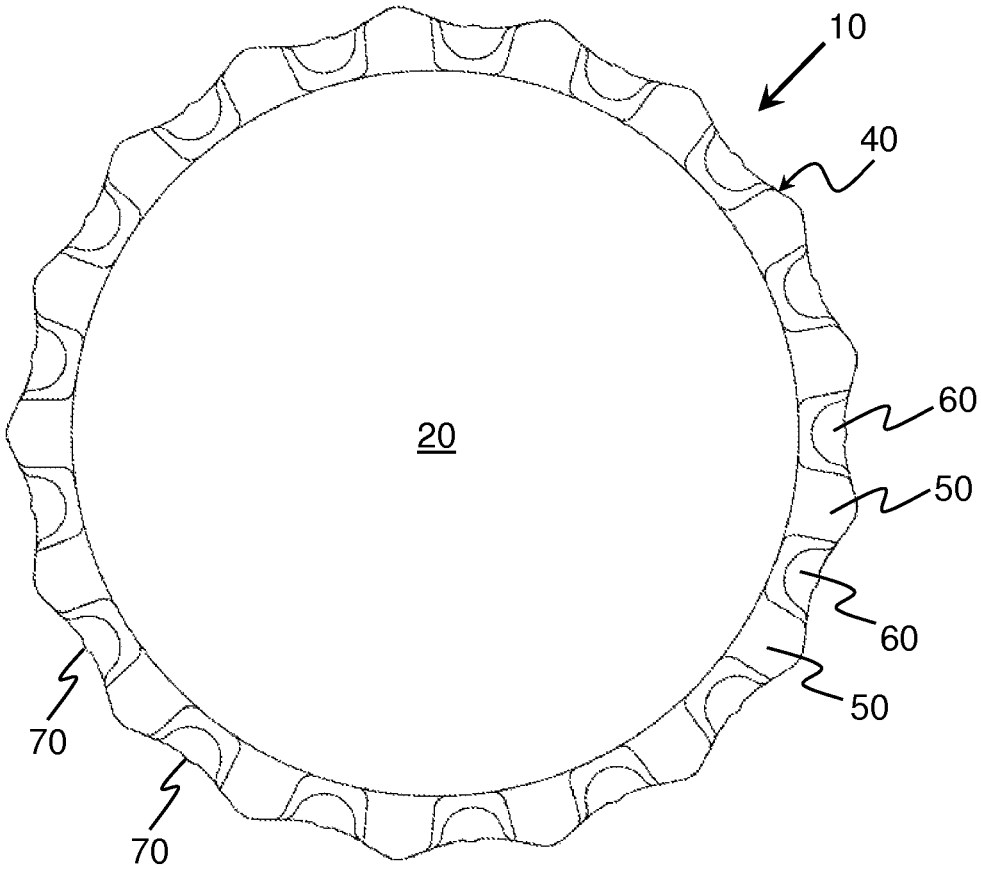
FIG. 3 shows a top view of a crown metal cap according to the invention. The crown metal cap is illustrated in its state prior before closure for sealing a mouth of a bottle.
Figure 4:
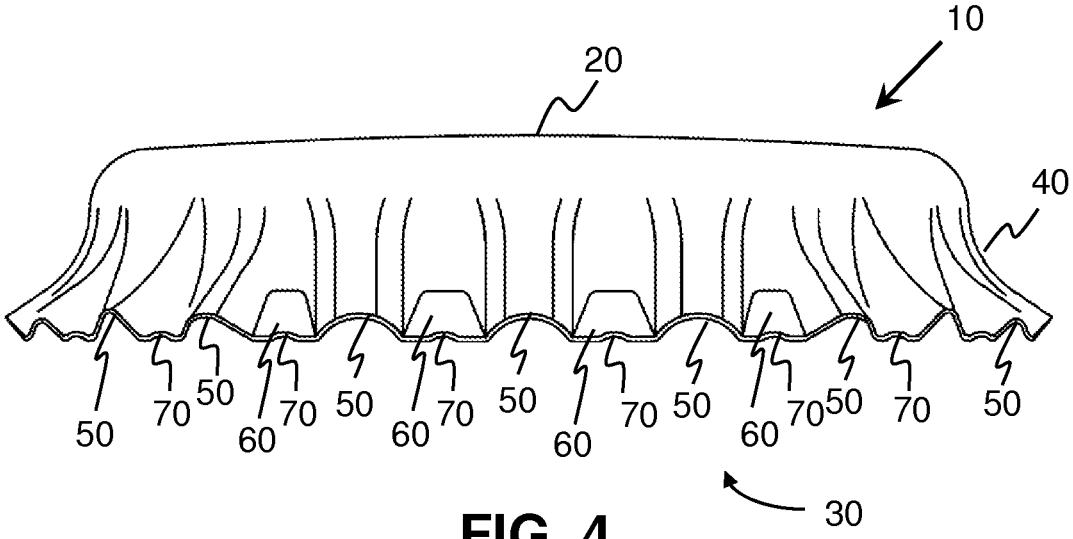
FIG. 4 shows a side view of the crown metal cap of FIG. 3 according to the invention. The crown metal cap is illustrated in its state prior before closure for sealing a mouth of a bottle.

In reference to FIGS. 3 and 4 which illustrate a crown metal cap according to the invention in its top view and side view respectively. The crown metal cap is shown in its state prior to its closure, before sealing a mouth of a bottle. The crown metal cap 10 consists of a laminated part with an outer face 20 and an inner face 30, a circular base and provided with a bell-shaped closure flange 40 formed perimetrically with a plurality of intercalated protrusions 50 and depressions 60, that allow its marginal folding over the mouth of a bottle that has to be sealed.

The crown metal cap 10 of the invention is made from metal sheets, preferably steel, having a thickness in a range of about 0.160 mm (0.00629 inch) to about 0.210 mm (0.00826 inch).

The outer face 20 is covered, optionally, with a non-pigmented or pigmented coating and which, by lithographic process, advertising is printed, for example, the brand of the drink or the bottler. In an alternative embodiment, the inner face 30 could be covered with a pigmented or non-pigmented coating that would give the crown metal cap 10 a distinctive character to distinguish and/or identify it with the naked eye, from the perspective of this face side compared with other metal caps, whether during its manufacture, storage, distribution, marketing or once it has been discarded.

Alternatively, the crown metal cap 10 includes a sealing gasket (not shown) in a circular form on the inner face 30 attached to or formed on the non-pigmented or pigmented coating to achieve a tight seal over the mouth of the bottle to be sealed. In another alternative embodiment, the crown metal cap 10 of the invention may be free of the sealing gasket.

In a first embodiment, each protrusion 50 of the closure flange 40 has a cross section curve with a substantially equal width along its entire length. In a second embodiment, each protrusion 50 may consist of an upper wall and a pair of opposing side walls giving the protrusion 50 a generally trapezoidal cross-section with a substantially equal width along its entire length. In addition, each protrusion 50 of the closure flange 40, either with a circular or trapezoidal cross section has a substantially equal height along its entire length.

In one embodiment of the invention, each depression 60 of the closure flange 40 has a substantially flat base with a width, measured from the edge closest to the outer face 20 to the outer edge of said depression 60, substantially along its entire length. Each depression 60 has a convex fold 70, which is located on the outer edge of the base is substantially flat, generally in its central part.

Figure 5:
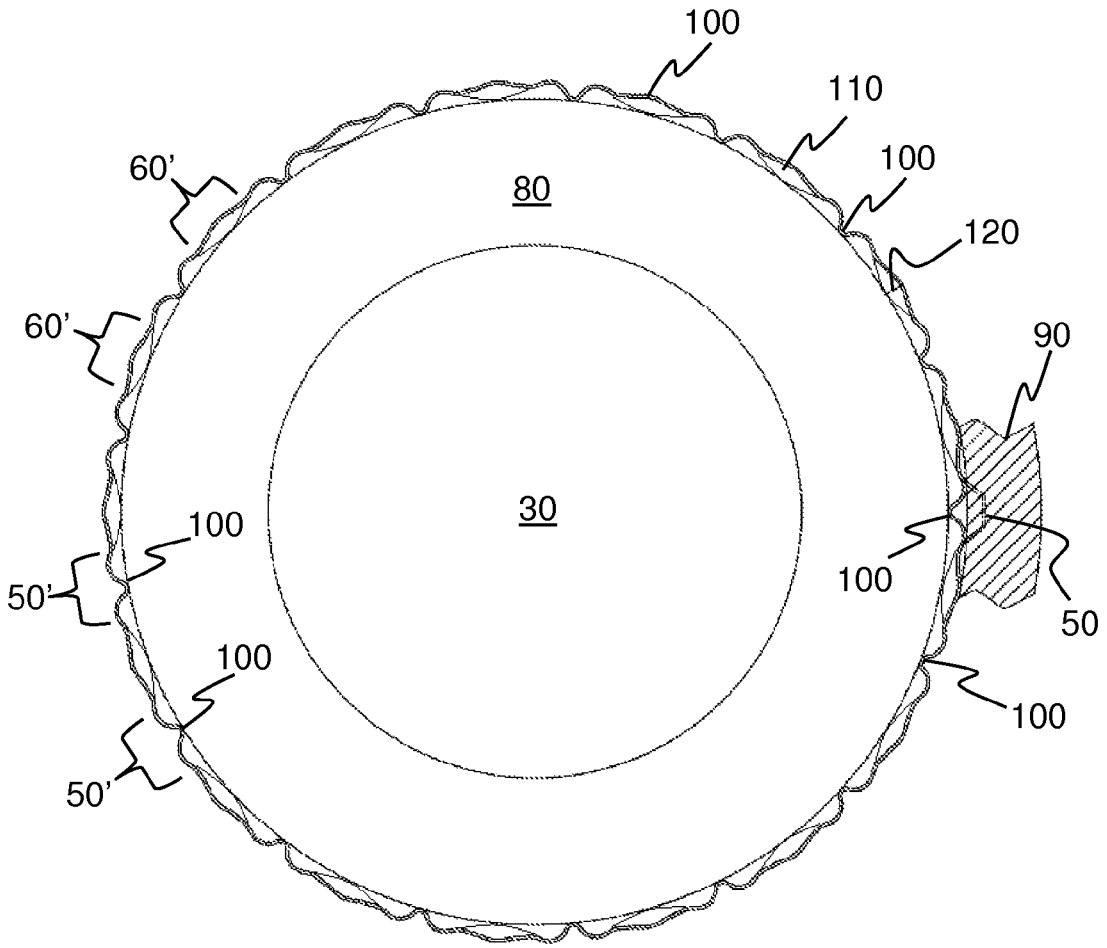
FIG. 5 shows a bottom view of the crown metal cap according to the invention being closed with a forming die. The crown metal cap is illustrated in its closed state sealing the mouth of a bottle.
Figure 6:
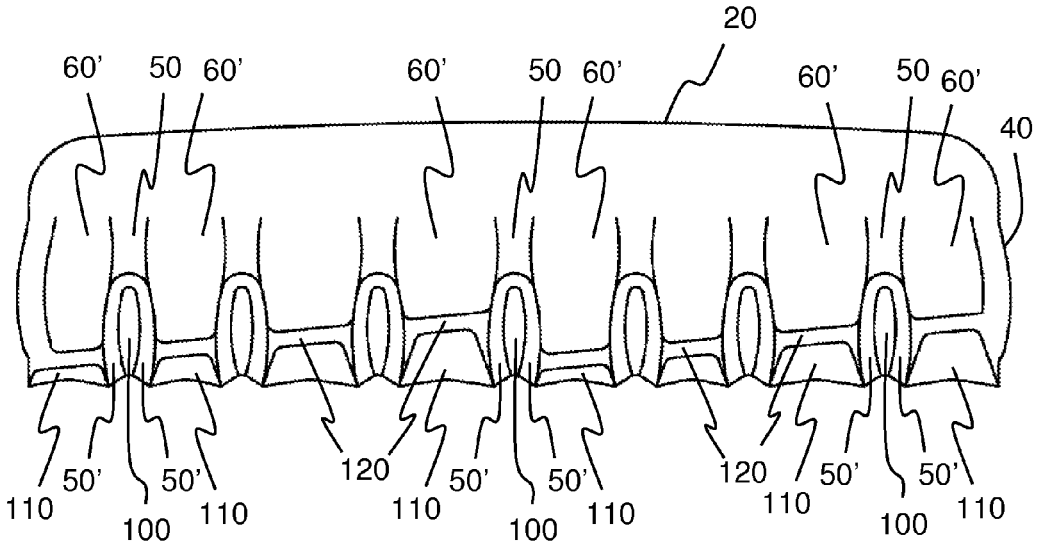
FIG. 6 shows a side view of the crown metal cap in FIG. 5 according to the invention. The crown metal cap is illustrated in its closed state sealing the mouth of a bottle.

In reference to FIGS. 5 and 6 which illustrates a crown metal cap closed according to the invention in a bottom view and side view respectively. The crown metal cap 10 is illustrated at the moment when it is placed over the mouth of the bottle 80 and a forming die 90 is run vertically and concentrically to fold the closure flange 40 over the mouth 80 of the bottle, so that when the closure flange 40 folds, each protrusion 50 collapses and forms a central depression 100 which acquires a form similar to the interior of a spheroid which splits the protrusion 50 into two minor protrusions 50' which acquire a curved shape, forming a surface of the flange that is comfortable to the touch for easy manual by turning the crown metal cap; while the convex fold 70 of each depression 60 of the closure flange 40 avoids the collapsing of the external edge of the depression 60 thus forming a bell-shaped opening edge 110 composed of the non-collapsed outer edge of the protrusion 60' delimiting at each end part of one external edge of a minor protrusion 50', that is, the external edge of the closure flange 40 folding of the crown metal cap that is formed by a plurality of bell-shaped opening edges 110 and the outer edges of the central depressions 100 intercalated with each other.

The closure flange 40, once folded presents on its surface a plurality of central depressions 100, minor protrusions 50' and depressions 60' that increase the contact area of the surface of the closure flange 40 for a correct and comfortable grip of the crown metal cap 10 for manual opening by applying a turn. The contact area for the hand grip with the surface of the closure flange 40 to open by turning the crown metal cap is approximately 48 $mm^2$ (0.0744 square inch) to about 65 $mm^2$ (0.1007 square inch), product of the sum of the area of each of the ridges of the minor protrusions 50'.

Each bell-shaped opening edge 110 in its central part is separated from the outer edge of the mouth 80 at a distance 120 of about 1.1176 mm (0.044 inch) to about 1.1938 mm (0.047 inch) and has a curve radius of about 0.3302 mm (0.013 inch) to about 0.4318 mm (0.017 inch), which is a distance and radius sufficient to allow to hook a bottle opener for proper opening of the crown metal cap 10 under this system without causing damage to the mouth 80 of said bottle or the crown metal cap 10.

Examples of Embodiments of the Invention

Next, there are several examples for comparative purposes to illustrate the advantages of the invention over the prior art, and that are intended at the same time to illustrate an embodiment of the invention but without limiting the scope thereof.

Example 1

Metal Cap of the State of the Art

A crown metal cap was produced of the "easy open" type as a control sample and in the state prior to its closure, with a sheet thickness of about 0.160 mm (0.00629 inch) and a closure flange formed by 21 protrusions of approximately 1.27 mm (0.05 inch) wide each and depressions intercalated about 2734 mm (0.1076 inch) in width each. Once the control crown metal cap is closed, the closure flange has a total area of contact for the hand grip of approximately 26.66 $mm^2$ (0.0413 square inch), product of the sum of the area of each of the protruding ridges once they are folded when they gain a straight form.

Example 2

Metal Cap According to the Invention

A crown metal cap "easy open" was produced to "comfortable feel" according to the invention and in its state prior to its closure, with a sheet thickness of about 0.160 mm (0.00629 inch) and a closure flange formed by about 17 protrusions of about 2.032 mm (0.08 inch) wide each and depressions intercalated of about 2734 mm (0.1076 inch) in width each. Once the control crown metal cap is closed, the closure flange has a total of 34 minor protrusions, curved with a total area of contact for the hand grip of about 50.66 $mm^2$ (0.0785 square inch), product of the sum of the area of each of the ridges of the minor protrusions.

Comparing the metal cap of the invention of Example 2 against the metal cap of the state of the art of Example 1, it shows that there is an increase of approximately 90% of contact area of the closure flange once closed, therefore, the metal cap of the invention turns out to be more comfortable to the touch for its opening by turning. Table 1 shows comparative data of both examples.

TABLE 1

| State of the crown metal cap | Parameter | Example 1 | Example 2 |
|---|---|---|---|
| Prior to its closure | Thickness of sheet | 0.160 mm | 0.160 mm |
| | Number of protrusions | 21 | 17 |
| | Width of each protrusion | 1.27 mm | 2.032 mm |
| | Width of depression | 2.734 mm | 2.734 mm |
| | Relation between width of the depression and the protrusion | 2.20 | 1.37 |
| Closed | Amount of resulting protrusions | 21 protrusions folded in straight form | 17 bifurcated protrusions in 34 minor protrusions of a curved form |
| | Contact area of the closed crown metal cap for opening by turning | 26.66 $mm^2$ (1.269 $mm^2$ for each straightly folded protrusion) | 50.66 $mm^2$ (2.98 $mm^2$ per pair of minor curved protrusions) |
| | Radius of curvature of each edge of bell-shaped opening | No edges of bell-shaped opening | 0.381 mm |

Whereas Example 2 illustrates a crown metal cap according to the invention with a design of 17 protrusions in its closure flange, it is apparent that the invention is not limited to this amount of protrusions, as it is also applicable to a design with 21 or 27 protrusions on the closure flange in its state prior to its closure. So once the crown metal cap of the invention is closed, a number of 34 to 54 minor protrusions of a curved form is obtained, depending on the number of protrusions of the flange before its closure.

Based on the alternative embodiments described above, it is contemplated that modifications to each of the embodiments described, as well as the embodiments of implementation alternatives will be considered obvious to a person skilled in the art of the art under the present description. It is therefore contemplated that the claims cover such modifications and alternatives are within the scope of the present invention.

The invention claimed is:

1. An open crown metal cap consisting of a laminar circular base and perimetrically provided with a bell-shaped closure flange formed by a plurality of intercalated protrusions and depressions, characterized in that said protrusions have a smaller width than the width of said depressions; and each depression includes on its outer edge a convex fold; and it is such that when the closure flange is folded over a mouth of a bottle to be sealed, each protrusion bifurcates into a pair of minor protrusions which acquire a curved shape separated by a central depression that takes a similar form in the interior of a spheroid, forming a surface of the flange comfortable to the touch for easy manual opening by turning the crown metal cap; whereas said convex fold of each depression prevents the collapse of the outer edge of the depression, thus forming a bell-shaped opening edge to facilitate the opening of the crown metal cap with a bottle opener.

2. The open crown metal cap of claim 1, characterized in that each protrusion of said closure flange has a circular or trapezoid cross section.

3. The open crown metal cap of claim 1, characterized in that each protrusion of said closure flange has a width substantially the same along its length.

4. The open crown metal cap of claim 1, characterized in that each protrusion of said closure flange has a height substantially the same along its length.

5. The open crown metal cap of claim 1, characterized in that each depression of said closure flange has a width substantially the same along its length.

6. The open crown metal cap of claim 1, characterized in that each depression and said closure flap have a depth substantially the same along its length.

7. The open crown metal cap of claim 1, characterized in that said closure flange has from 17 to 27 protrusions.

* * * * *